United States Patent [19]

Baglin

[11] 4,082,046

[45] Apr. 4, 1978

[54] DISPLAY UNIT

[76] Inventor: Yves Baglin, 8 rue des Jonquilles, Boissise le Roi, France

[21] Appl. No.: 768,424

[22] Filed: Feb. 14, 1977

[51] Int. Cl.[2] ..... A47B 46/00

[52] U.S. Cl. ..... 108/106; 108/111; 108/101

[58] Field of Search ..... 108/106, 91, 51.1, 51.5, 108/56.3, 149, 156, 101, 110, 111; 248/188.5

[56] References Cited

U.S. PATENT DOCUMENTS

| | | | |
|---|---|---|---|
| 1,142,932 | 6/1915 | Clark | 108/101 X |
| 1,227,681 | 5/1917 | Simms | 108/91 |
| 2,623,633 | 12/1952 | Bladow | 108/91 |
| 3,480,154 | 11/1969 | Telfer | 108/91 X |
| 3,664,272 | 5/1972 | Sanders | 108/56.3 |
| 3,682,323 | 8/1972 | Bergquist | 108/110 |
| 3,867,887 | 2/1975 | Saidel | 108/56.3 X |

*Primary Examiner*—Francis K. Zugel
*Attorney, Agent, or Firm*—George H. Mitchell, Jr.

[57] ABSTRACT

This display unit comprises a plurality of superposed shelves or trays and is adapted to be extended from a minimum storage or shipping height to a maximum or operative height by simply pulling one of the endmost shelves or trays, each shelf or tray carrying along only the next one, means being provided for interlocking all the shelves or trays in their operative position.

4 Claims, 5 Drawing Figures

Fig.1
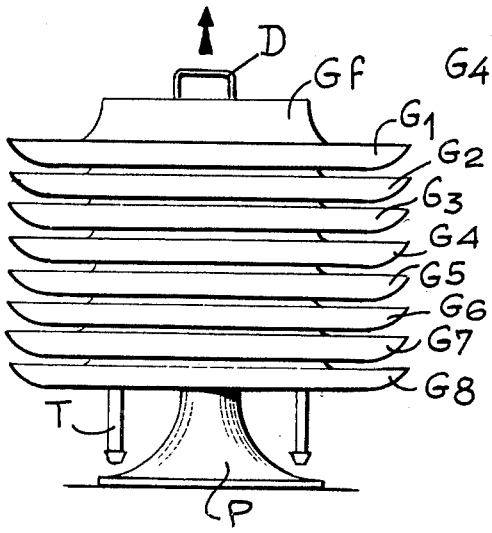
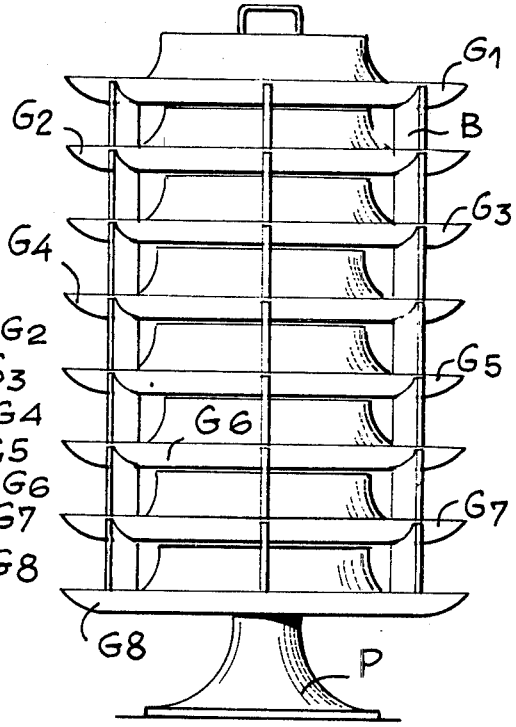
Fig.2
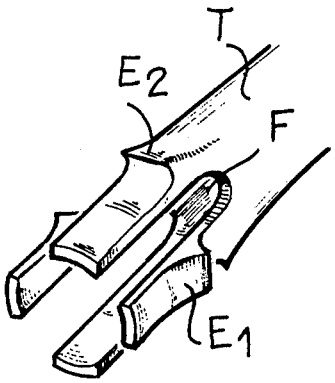
Fig.5
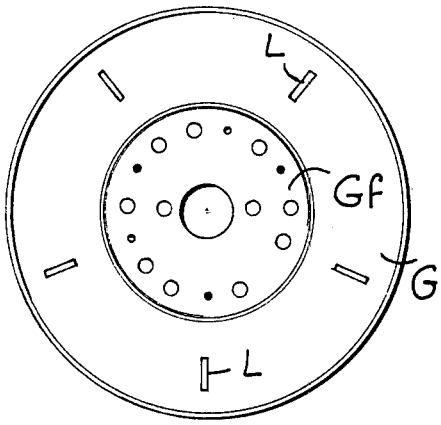
Fig.3

DISPLAY UNIT

BACKGROUND OF THE INVENTION

1. Field of the Invention

This invention relates to an improved type of display unit of the shelf or tray type, for displaying miscellaneous articles, notably spectacles.

2. Description of the Prior Art

Hitherto known display units are of two main types, namely those delivered ready for use and those consisting of modular elements the assembly of which is left to the user and performed on the spot.

The display units of the first group are objectionable on account of their unduly large dimensions, both for storage and for shipping, notably on account of the necessarily expensive and large-sized packings required therefor.

Display units of the above-mentioned second group require tedious work and efforts from the user which are not always accepted with pleasure.

DESCRIPTION OF THE INVENTION

The present invention is directed to avoid these inconveniences characterizing prior art display units by providing a novel type of display unit having a relatively moderate volume for storage purposes and also for shipping same, while requiring only a very simple manoeuvre from the user for attaining its final over-all dimensions.

Finally, the display unit according to this invention is advantageous in that it comprises only a limited number of modular elements so that its cost is relatively moderate.

According to this invention, this display unit comprises a plurality of shelves or trays adapted to be stacked upon one another during the storage and shipping period, and means for interconnecting said shelves or trays so that moving the endmost shelves or trays away from each other will cause the complete unit to expand and assume its final height without requiring any other manoeuvre.

Furthermore, this display unit comprises means for locking the shelves or trays in their final or operative position.

Other features and advantages of this invention will appear as the following description proceeds with reference to the attached drawing, in which:

BRIEF DESCRIPTION OF THE DRAWING

FIGS. 1 and 2 illustrate a display unit according to this invention in its storage position and operative position, respectively;

FIG. 3 is a plan view from above showing a modular element constituting a shelf or tray of the unit illustrated in FIGS. 1 and 2;

FIG. 5 is a fragmentary perspective view showing the means contemplated for interconnecting the shelves or trays.

DESCRIPTION OF THE PREFERRED EMBODIMENT

Figure 4:
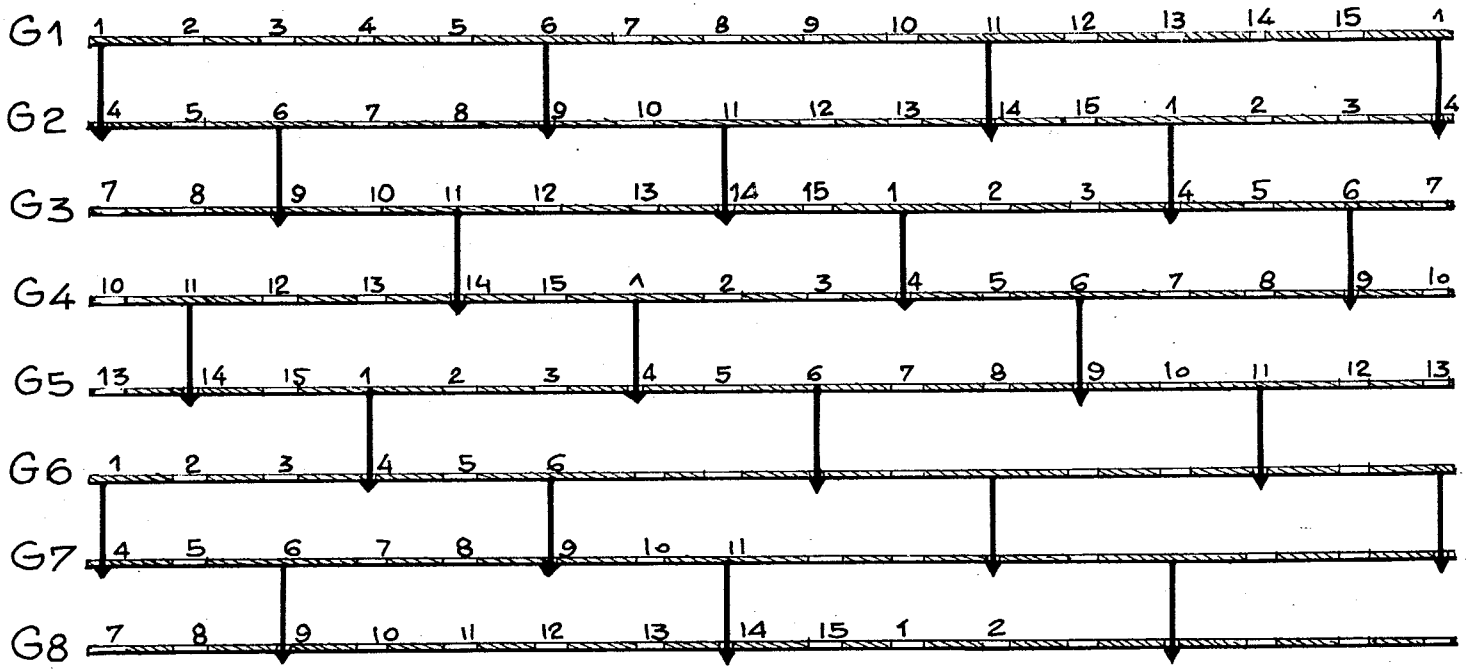
FIG. 4 is a developed diagram showing the method of assembling the shelves or trays in their operative position.

As illustrated in the attached drawing showing a typical embodiment of the present invention, the display unit according to this invention comprises a plurality of modular elements in the form of identical shelves or trays G ($G_1$ to $G_8$) adapted to be stacked in the fashion of hats or dishes, as shown in FIG. 1.

The top surface $G_f$ of each element has formed therethrough three series of holes disposed on a common circle, for a purpose to be explained presently, and a central hole C permitting the passage of a vertical column constituting the upstanding extension of the base or foot P.

In the device illustrated by way of example each shelf G is adapted to be divided into five compartments by means of partition strips B extending through slots L formed through the marginal portions of said shelves. Each shelf is assembled with the adjacent, underlying shelf by means of three rods T.

As shown in FIG. 3 the central upper surface $G_f$ is divided by fifteen spaced radii numbered 1 to 15 (five times three). On radii 1, 6 and 11, i.e. at a relative angular spacing of 120°, the rods T are firmly secured to the bottom surface of the shelves so as to depend at right angles therefrom. The radii 2, 3, 5, 7, 8, 10, 12, 13 and 15 are occupied by relatively larger holes through which said rods T can pass freely, i.e. with ample clearance, in contract to radii 4, 9 and 14 where circular holes only slightly greater than the diameter of said rods T are formed.

As will be explained presently, the free end of each rod T is formed with a head adapted to be snappily engaged through the holes 4, 9 and 14 in order to retain the underlying shelf, as illustrated in FIG. 4.

This FIG. 4 also shows clearly in developed circumferential view that the various shelves or trays $G_1$ to $G_8$ are shifted angularly to one another so that the point or radius 1 of the uppermost shelf or tray $G_1$, where a rod T is attached, corresponds to the point 4 of tray or shelf $G_2$, to point 7 of $G_3$, to point 10 of $G_4$, to point 13 of $G_5$, to point 1 of $G_6$, and so forth.

Therefore, in the initial storage or shipping position as shown in FIG. 1 the rods T secured to the bottom of shelf $G_1$ at points 1, 6 and 11 extend through the small holes provided at 4, 9 and 14 of the next shelf $G_2$ and through the larger holes of shelves $G_3$, $G_4$ and $G_5$.

Similarly, the rods T secured to shelf $G_2$ at 6, 11 and 1 extend through small holes 9, 14 and 4 of shelf $G_3$ and also through the larger holes of shelves $G_4$, $G_5$ and $G_6$ underlying these rods.

Of course, the same applies to the rods of the other shelves.

It will be readily understood that when the endmost shelves or trays (in this case $G_1$ and $G_8$) are moved away from each other, for example by pulling upwards the handle D secured to shelf $G_1$, this shelf $G_1$ will move away from $G_2$ until the heads of the rods T secured to $G_1$ engage the circular edges of the small holes of shelf $G_2$ through which they cannot pass freely.

Continuing this upward movement will thus carry along shelf $G_2$ and the rods T attached thereto, until the heads of these rods engage in turn the small holes of shelf $G_3$ which will move likewise away from $G_4$ until the heads of its rods T engage the circular edges of the small holes of $G_4$, and so forth.

In the storage position illustrated in FIG. 1, the three rods T carried by the lowest shelves, which extend through the larger holes of the lowermost shelf $G_8$, will be visible in the free space left therebeneath around the base or leg P.

The vertical column rigid with this base or leg P extends through the central holes C and its height may not exceed, if desired, the height of the stacked shelves in the storage and shipping position shown in FIG. 1. In the case of display units of relatively great height, the stability may be improved by providing a longer central column consisting for example of a plurality of tubular elements telescopically interfitting one another, for example like some known fishing rods.

The partition strips B serving only the purpose of dividing the individual trays or shelves into well-defined compartments may be adapted to be either folded (in the case of plastic sheets or fabric strips) or elongated (sliding elements).

From the foregoing it will readily occur that the main component of the display unit according to the instant invention is the rod T.

As shown in FIG. 5, the free end of each rod T comprises firstly four longitudinal slots F disposed along spaced generatrices disposed by pairs in two perpendicular planes so as to enable this end portion to be contracted radially, these slots being completed by two pairs of spurs $E_1$, $E_2$ permitting the snap engagement of the head with respect to the relevant shelf or tray.

The first pair of spurs $E_1$ act as abutment elements to prevent the rod head from extending completely through the small hole of the corresponding shelf, and the other spurs $E_2$ formed in the opposite direction and which, due to their external slope and the elasticity afforded by the presence of slots F, have passed through this small hole, subsequently resume their normal unstressed position in order to engage the top surface of the central area of the shelf.

Thus, this shelf is held against any vertical or axial movement between two pairs of spurs.

The locking action thus obtained prevents the shelves or trays from moving toward each other and therefore the complete display unit from collapsing and resuming its storage and shipping position.

Of course, this invention is also applicable to linear display units and to display units of any other configuration. Besides, even in the case of circular of polygonal display units, the arrangement of the holes formed through the central surface $G_f$ of the shelves or trays may differ from the one disclosed and illustrated herein by way of example.

Similarly, though the display unit shown and described herein comprises eight shelves or trays, it will readily occur to those conversant with the art that any other suitable number of shelves or trays may be used without departing from the basic principles of the invention.

The main feature characterizing this invention and to be applied to all practical embodiments thereof lies in the fact that the rods T secured to the bottom of one shelf must be capable of snappily engaging the next underlying shelf in the position shown in FIG. 2, so as to provide a locking engagement between the two shelves concerned, said rods T being on the other hand capable of passing freely through the other shelves in the storage or shipping position shown in FIG. 1.

What is claimed as new is:

1. A collapsible display unit comprising a plurality of superposed identically formed shelves adapted to receive articles to be displayed when the unit is extended, said display unit being normally stored in collapsed condition, each of said shelves including support means in slidable engagement with an adjacent shelf by means of a series of holes in said shelf, said support means comprising a set of vertical rods rigidly secured to, and depending from, the bottom surface of each shelf and provided at their lower ends with locking means, said locking means engaging both the top and bottom surfaces of the adjacent shelf for positive locking engagement when a shelf is extended away from said adjacent shelf by a predetermined distance and preventing not only the shelves from being pulled apart and separated from each other when the unit is being expanded but also preventing collaping of the shelves one upon another once they have been expanded.

2. A display unit as recited in claim 1, wherein each shelf has two series of holes formed therethrough, the holes of the first series being larger than those of the second series, whereby the holes of the first series permit the free passage of said locking means of the other shelves, and the holes of the second series of locking holes are adapted to be positively engaged by said locking means of the rods carried by the next adjacent and overlying shelf.

3. A display unit as recited in claim 2, wherein said shelves have a circular configuration and said rods are secured to the central area of a shelf, the two series of holes being equally spaced from one another and disposed on a common circle, a free-passage hole being provided between each rod fastening point and the next locking hole.

4. A display unit as recited in claim 3, wherein all the shelves are identical but shifted angularly to one another so that one rod rigid with one shelf registers with a locking hole of the next underlying shelf, and also with a free passage hole of the next shelves to permit the free passage of said one rod when the shelves are stacked on one another in their storage position.

* * * * *